US009033758B2

(12) United States Patent
Burns

(10) Patent No.: US 9,033,758 B2
(45) Date of Patent: May 19, 2015

(54) MONEY SAVING SYSTEM

(76) Inventor: Peggy Ann Winona Burns, Hamilton (BM)

( * ) Notice: Subject to any disclaimer, the term of this patent is extended or adjusted under 35 U.S.C. 154(b) by 326 days.

(21) Appl. No.: 13/072,327

(22) Filed: Mar. 25, 2011

(65) Prior Publication Data

US 2012/0244776 A1 Sep. 27, 2012

(51) Int. Cl.
*A45C 1/12* (2006.01)

(52) U.S. Cl.
CPC ..... *A45C 1/12* (2013.01)

(58) Field of Classification Search
USPC ..... 446/8, 9, 10, 11, 12, 13, 484; 434/107, 434/110
See application file for complete search history.

(56) References Cited

U.S. PATENT DOCUMENTS

| | | | | | |
|---|---|---|---|---|---|
| 2,622,365 | A | | 12/1952 | Grow | |
| 3,186,588 | A | | 6/1965 | Chapman | |
| 3,243,914 | A | * | 4/1966 | Poynter | 446/9 |
| 3,276,835 | A | | 10/1966 | Hall | |
| 3,329,277 | A | | 7/1967 | Gaudino | |
| 4,246,915 | A | | 1/1981 | Hall | |
| D273,908 | S | | 5/1984 | Hoogeveen | |
| 4,638,121 | A | * | 1/1987 | Clark, Jr. | 379/145 |
| 4,815,998 | A | * | 3/1989 | McGuire | 446/8 |
| 4,955,052 | A | * | 9/1990 | Hussain | 379/148 |
| 5,046,085 | A | * | 9/1991 | Godsey et al. | 379/144.01 |
| 5,427,231 | A | | 6/1995 | Willimann | |
| 5,465,909 | A | * | 11/1995 | Roth | 232/1 D |
| 6,116,977 | A | * | 9/2000 | Tanny et al. | 446/8 |
| 6,651,797 | B1 | * | 11/2003 | Tree | 194/352 |
| 6,902,459 | B2 | | 6/2005 | Kim | |
| 2008/0261480 | A1 | | 10/2008 | Chan | |
| 2009/0176432 | A1 | * | 7/2009 | Hardin et al. | 446/8 |

* cited by examiner

*Primary Examiner* — Nini Legesse
(74) *Attorney, Agent, or Firm* — JP Webb; Jason P. Webb; Danny Y. H. Cheng

(57) ABSTRACT

A system for facilitating the saving of money including a container having a slot disposed through a top surface of the container. The system includes a hinged door, a hook member, and a locking device. The system includes a slot sensor module configured to sense objects passing through the slot; and a hook sensor module configured to sense utilization of the hook member. The system includes an audio module configured to provide audio broadcasts. The system includes a control module configured to provide operational controls to the modules of the system. The control module includes a timing module and program module, the program module including an instruction set providing for an audio broadcast of the audio module triggered by a predetermined association of a sensor event and the passing of a predetermined period of time. The system includes a first bag and a second bag configured to store money.

15 Claims, 5 Drawing Sheets

MONEY SAVING SYSTEM

BACKGROUND OF THE INVENTION

1. Field of the Invention

The present invention relates to systems, specifically to a money saving system.

2. Description of the Related Art

Penny bank or a money box is the traditional name of a coin accumulation and storage receptacle; it is most often, but not exclusively, used by children. The penny bank is known to collectors as a "still bank" as opposed to the "mechanical banks" popular in the early 20th century. Many financial services companies use penny banks as logos for their savings products. Penny banks are slowly becoming extinct due to the modernizing of young children which encourages them to open a junior savings account, instead of keeping their money safe in a penny bank. Some improvements have been made in the field. Examples of references related to the present invention are described below in their own words, and the supporting teachings of each reference are incorporated by reference herein:

U.S. Pat. No. 6,902,459, issued to Kim, discloses a coin bank equipped with a recreational function is developed for stimulating an interest in saving money while amusing the children. When a coin is successfully thrown into a target hole, the coins previously thrown and accumulated in the body are drained into a coin bank for storing while performing various amusing events. The coin bank comprises: a body (10) consisting of a target hole (13), a coin receiving part (14) with an open top (11) and a coin outlet (12) for discharging the accumulated coins, a shutter (20) for blocking the coin outlet, a shutter operating mechanism (30), a plurality of transparent pipes (41) vertically extended for supporting the body (10) and used as a coin storing container (40), and a control unit (35) consisting of a driving motor (33), at least one sensor (31), flashing lights (50), voice generators (60) and a dancing doll (70) for performing amusing events.

U.S. Pat. No. 5,427,231, issued to Willimann, discloses an organizer (20, 60, 90) for personal accessories which is mountable on a wall and comprises a container box (21, 61, 93) with structural members (29, 30, 69, 70) configured to provide shelves and trays and having a plurality of item retention devices including screw hooks (50-52, 75,76) and pockets (55, 83,97 which are affixed thereto for accommodating the assembly, storage and retention of personal accessories in a single convenient location.

U.S. Pat. No. 4,246,915, issued to Hall, discloses an improved portable coin bank having at least one tubular member configured to retain a stack of coins of a particular denomination and for permitting the lowermost coin of the stack to be manually dispensed as required comprising a lower support portion having an inclined bottom support surface having a first U-shaped cut to facilitate removal of a coin and extending more than half-way around the periphery of the tube, a second U-shaped cut in the front of the tube conterminous with the first U-shaped cut, and a pair of parallel slits on either side of the second opening extending upward from the lower support portion and each pair defining a spring member for retaining the stack of coins and permitting withdrawal of the lowermost coin by flexing radially outward. Between the second U-shaped opening and each spring member there is provided an arched portion which serves to prevent additional coins from being inadvertently dispensed as the lowermost coin is withdrawn. In a preferred embodiment, the improved coin bank comprises three such tubular members each for retaining a stack of coins of a different denomination.

U.S. Patent Application Publication No.: 2008/0261480, by Chan, discloses an interactive money box fosters the habit of saving in children by displaying animated characters in response to insertion of coins into a money box. Characters may also be displayed in response to failure to insert coins for a period of time or at a given rate.

The inventions heretofore known suffer from a number of disadvantages which include being limited in application, being difficult to manage, being limited in educational learning, being limited in children educational learning, being limited in saving ability at home, failing to appropriately interact with users, failing to facilitate transfer of funds to a savings institution, and failing to induce positive behavior.

What is needed is a money saving system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available money saving systems. Accordingly, the present invention has been developed to provide an effective and efficient system of saving money.

According to one embodiment of the invention, there may be a system for facilitating the saving of money. The system may include a container configured to provide a housing for the components and modules of the system. The system may include a slot that may be disposed through a top surface of the container, configured to receive money. The system may include a hinged door that may be coupled to a side of the container configured to selectively pivot. The system may include a hook member that may extend outwardly from a side of the container. The system may include a locking device that may be coupled to the hinged door and/or configured to secure the contents of the container. The system may include a wall mount that may be coupled to an exterior surface of the container and/or configured to couple the container to a wall or surface.

The system may include a slot sensor module that may be disposed within the container near the slot, configured to sense objects passing through the slot. The system may include a hook sensor module in communication with the hook member and configured to sense utilization of the hook member. The system may include an audio module that may be coupled to the container and configured to provide audio broadcasts. Furthermore, the system may include a power module in communication with the control module and configured to provide power to the components and modules of the system. The system may include a clock module in communication with the control module and configured to display a time.

The system may additionally include a control module that may be disposed within the container and in communication with the audio module, the slot sensor module, and the hook sensor module, and configured to provide operational controls to the modules of the system. The control module may include a timing module and program module, the program module includes an instruction set providing for an audio broadcast of the audio module triggered by a predetermined association of a sensor event and the passing of a predetermined period of time. The instruction set may trigger an audio broadcast when the hook member is utilized and a predetermined period of time passes without the slot sensor module detecting use of the slot. The instruction set may trigger an audio broadcast when the slot sensor module detects utilization of the slot. The system may include a first bag, configured to store money and having an internal volume larger than about an internal volume of the container; and a second bag, configured to store money. The second bag may be a personal change bag.

According to one embodiment of the invention, there is a kit for facilitating the saving of money. The kit may include a container configured to provide a housing for the components and modules of the kit. The kit may include a slot through the container, configured to receive money. The kit may also include a hinged door that may be coupled to a side of the container configured to selectively pivot. The kit may include a hook member that may extend from a side of the container. The kit may include a first bag, configured to store money and having an internal volume larger than about an internal volume of the container; and a second bag, configured to store money. The second bag may be a personal change bag. The kit may include an instruction booklet or card, pamphlet configured to provide instructions for the saving of money. The kit may include a locking device that may be coupled to the hinged door and configured to secure the contents of the container.

The kit may also include a slot sensor module that may be disposed within the container near the slot, configured to sense objects passing through the slot. The kit may include a hook sensor module in communication with the hook member and configured to sense utilization of the hook member. The kit may include an audio module that may be coupled to the container and configured to provide audio broadcasts. In addition, the kit may include a control module that may be disposed within the container and in communication with the audio module, the slot sensor module, and the hook sensor module, and configured to provide operational controls to the modules of the kit. The control module may include a timing module and program module, the program module including an instruction set providing for an audio broadcast of the audio module triggered by a predetermined association of a sensor event and the passing of a predetermined period of time.

According to one embodiment of the invention, there is a device for facilitating the saving of money. The device may include a container configured to provide a housing for the components and modules of the device. The device may include a slot that may be disposed on a top surface of the container, configured to receive money. The device may also include a hinged door that may be coupled to a side of the container configured to selectively pivot. The device may include a hook member that may extend from a side of the container. The device may include a locking device that may be coupled to the hinged door and configured to secure the contents of the container.

The device may include a slot sensor module that may be disposed within the container near the slot, configured to sense objects passing through the slot. The device may include a hook sensor module that may be disposed within the container near the hook member, configured to sense utilization of the hook member. The device may include an audio module that may be disposed within the container and in communication with the slot sensor module and the hook sensor module, and configured to provide audio broadcasts. The device may include a power module in communication with the control module and configured to provide power to the components and modules of the device.

The device may include a control module that may be disposed within the container and in communication with the audio module, the slot sensor module, and the hook sensor module, and configured to provide operational controls to the modules of the device. The control module may include a timing module and program module, the program module including an instruction set providing for an audio broadcast of the audio module triggered by a predetermined association of a sensor event and the passing of a predetermined period of time. The instruction set may trigger an audio broadcast when the hook member is utilized and a predetermined period of time passes without the slot sensor module detecting use of the slot. The instruction set may trigger an audio broadcast when the slot sensor module detects utilization of the slot.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
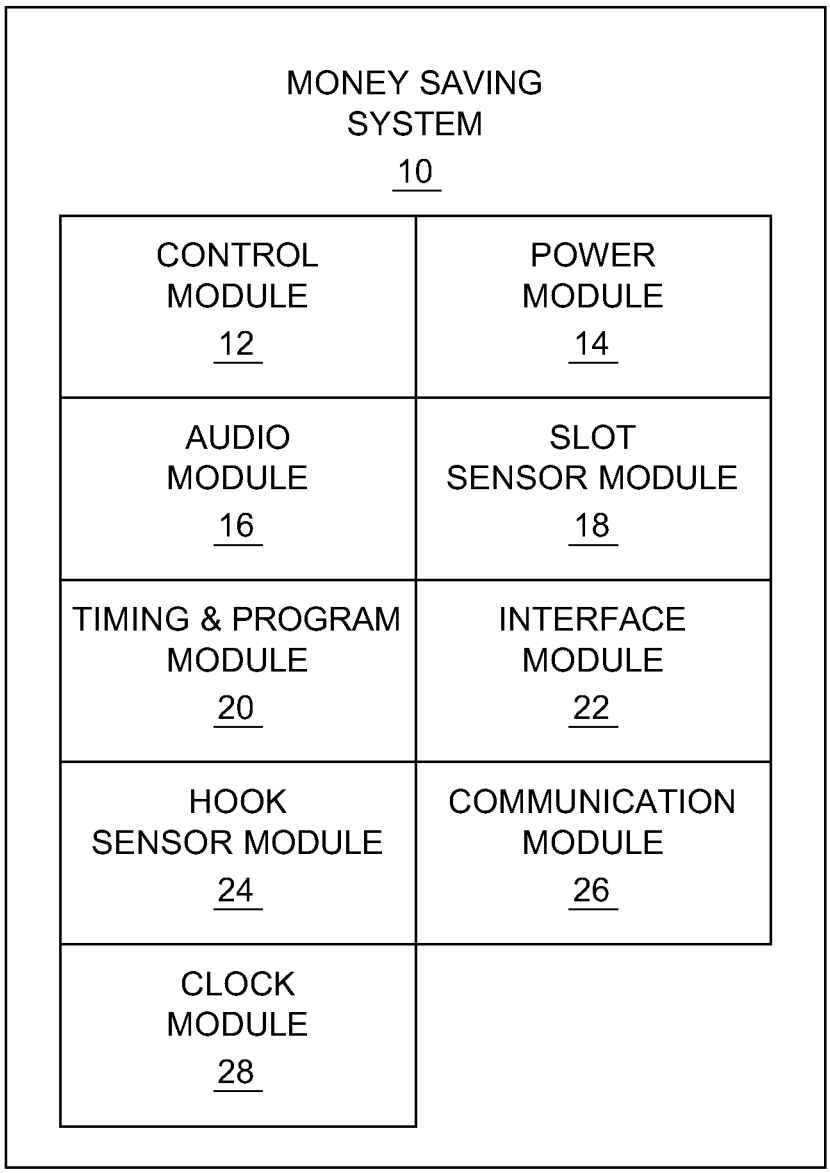
FIG. 1 is a module diagram of a money saving system, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a module diagram of a money saving system, or Incentive Creating Financial Freedom System, according to one embodiment of the invention. There is shown a money saving system 10 including: a control module 12, a power module 14, an audio module 16, a slot sensor module 18, a timing and program module 20, an interface module 22, a hook sensor module 24, a communication module 26, and a clock module 28. The illustrated modules may be in communication, one with another, to the degree and in the manner that one of ordinary skill in the art would recognize as appropriate and useful in performing their respective functions. The illustrated modules operate to promote and/or facilitate the saving of money.

In particular, the illustrated money saving system includes a power module to provide power to the system, a control module to control/manage/instruct/etc. portions of the system, one or more sensor modules to detect money saving events and/or events associated with the same, an audio module play user interactive media, an interface module to permit a user/operator/administrator to selectably interact with the system and/or to alter operational characteristics of the same, a timing and program module to provide data that may include but is not limited to media information, scripts, instructions, operational characteristics, and the like, a clock module configured to generate clock information for use by other modules, and a communication module to permit the system to communicate with other devices such as but not limited to personal computers, information networks, storage devices, and the like.

In operation, events associated with money saving (hanging keys on a key hook at the end of a day of work, etc.) are observed along with any associated money saving events (coins dropping into a storage bank, etc.). Wherein associated events are detected but not accompanied by actual money saving events, the system triggers media play/display to gently remind the user to perform a money saving event. Where the system detects an actual money saving event, the system may trigger media play/display to provide a message of positive reinforcement for the same. Accordingly, the system promotes positive saving behavior.

The system may include a housing, such as but not limited to a box, safe, sealed container, or the like wherein money may be stored. The system may include an interaction object/device/system, such as but not limited to a key hook, button, drawer, shelf, or the like wherein a user may perform a (daily, weekly, monthly, etc.) task associated in some manner with the earning or receiving of money. Accordingly, the system may interact with users in a meaningful manner.

The illustrated control module 12 is configured to provide operational instructions to the components and modules of the money saving system 10. The control module 12 is configured to provide instructions to the modules and components of the system 10. The control module 12 is configured to respond to a sensor event or a trigger from the components and modules of the system 10. A control module may include but is not limited to a processor, a state machine, a script, a decision tree, and the like. Non-limiting examples of a control module may be a control module described in U.S. Pat. No. 5,430,836, issued to Wolf et al.; or a control module described in U.S. Pat. No. 6,243,635, issued to Swan et al. which are incorporated for their supported teachings herein.

The illustrated control module 12 is in communication with a power module 14. The power module 14 is configured to provide power to the components and modules of the money saving system 10. The power module 14 may be a replacement power source, such as but not limited to batteries, or the power module 14 may include a base power source, such as an outlet power plug configured to directly couple the system 10 to a power source. Non-limiting examples of a power module may be a power module described in U.S. Pat. No. 6,337,803, issued to Kikcuhi et al.; or a power module described in U.S. Pat. No. 5,608,595, issued to Gourab et al. which are incorporated for their supported teachings herein.

The illustrated control module 12 is also in communication with an audio module 16. The audio module 16 is configured to broadcast audio messages. The illustrated control module 12 is configured to send instructions to the audio module 16 to broadcast a pre-set audio message. The audio module 16 is configured to broadcast an audio message when the control module receives a sensor event or a trigger from the components and modules of the system 10. The control module 12 may receive a sensor event or a trigger from the slot sensor module 18 and/or the hook sensor module 24, thereby triggering the audio module 16 to broadcast a pre-set audio message. The audio module may include but is not limited to a speaker, headphones, a horn, a musical instrument, and a noise-making device. A non-limiting example of an audio module may be a self-contained motion sensitive audio module as described in U.S. Pat. No. 7,755,471, issued to Jackson, which is incorporated for its supported teachings herein.

The illustrated system 10 includes a slot sensor module 18 configured to detect an object passing through a slot of the system. The illustrated slot sensor module 18 is in communication with the audio module 16 and configured to send a sensor event or a trigger thereto, through the control module 12, once an object passes through the slot and by the slot sensor module 18. The audio module 16 is configured to broadcast a pre-recorded audio recording. The pre-recorded audio recording, upon receiving a sensor event or a trigger from the slot sensor module, is a celebratory recording for depositing money in the system. The pre-set audio recording may include reinforcing the thought of saving money. A slot sensor module may include but is not limited to a wire trigger, IR detector, laser interrupt sensor, and the like. Non-limiting examples of a sensor module may be a sensor module as described in U.S. Pat. No. 6,593,732, issued to Dammkhler et al.; or a weight sensor module as described in U.S. Pat. No. 6,099,032, issued to Cuddihy et al. which is incorporated for their supported teachings herein.

The illustrated system 10 includes a hook sensor module 24 in communication with a hook member. The illustrated hook sensor module 24 is also in communication with the control module 12 and the audio module 16. The hook sensor module 24 is configured to send a sensor event or a trigger to the audio module, through the control module 12, once an object is placed on the hook member. The audio module 16, upon receiving a sensor event or a trigger from the hook sensor module 24, through the control module 12, the audio module 16 is configured to broadcast a pre-set audio recording. The audio recording, once an object is placed on the hook member, is a request recording to deposit money in the system or a reminder to save money utilizing the system 10. A hook sensor module may include but is not limited to an electrostatic sensor, a pressure transducer, a temperature transducer, a motion detector, and the like. Non-limiting examples of a sensor module may be a sensor module as described in U.S. Pat. No. 6,593,732, issued to Dammkhler et al.; or a weight sensor module as described in U.S. Pat. No. 6,099,032, issued to Cuddihy et al. which is incorporated for their supported teachings herein.

The illustrated system 10 includes a timing and program module 20 in communication with the control module 12. The illustrated timing and program module 20 is configured to send a sensor event or a trigger to the audio module 16, perhaps through the control module 12, when the slot sensor module and the hook sensor module have not sent a sensor event or a trigger to the audio module during a set amount of time. The timing and program module is configured to track the time in between sensor events or triggers for both the slot sensor module and the hook sensor module. The audio module, after receiving a sensor event or a trigger from the timing and program module, broadcasts a pre-set audio recording. The audio recording broadcast may be a gentle and polite announcement that it is time to deposit money into the system or a reminder of a previous intention to save money, or a reinforcement of a teaching to save money, and etc. A non-limiting example of a timing and program module may be a programmable timing module as described in U.S. Pat. No. 6,813,722, issued to Yeh, which is incorporated for its supported teachings herein.

The illustrated system 10 includes an interface module 22 in communication with the control module 12. The illustrated interface module 22 is configured to provide adjustable operational controls to the user through the control module 12 for the system 10. The interface module 22 is in communication with the audio module 16 and is configured to provide volume controls thereto. The interface module 22 is in communication with the slot sensor module 18 and the hook sensor module 24 and is configured to provide sensor sensitivity controls thereto to each module. The interface controls 22 is also in communication with the timing and program module 20, wherein the interface module 22 is configured to adjust the amount of time in between sensor events or triggers before the timing and program module sends a sensor event or a trigger to the audio module 16 top broadcast an audio message. An interface module may include a touch screen, a mouse, an LCD display, a control panel, and the like. Non-limiting examples of a display/interface module may be a display/interface module as described in U.S. Pat. No. 6,272,562, issued to Scott et al. which is incorporated for its supported teachings herein.

The system 10 includes a communication module 26 configured to send and receive data to and from the modules and components of the system. The illustrated communication module is configured to relay through the control module, a sensor event or a trigger from the slot sensor module, the hook sensor module, and/or the timing and program module. The communication module is configured to relay the data and information wirelessly or directly through the control module. Non-limiting examples of a communication module may be but not limited to: a communication module described in U.S. Pat. No. 5,307,463, issued to Hyatt et al.; or a communication module described in U.S. Pat. No. 6,133,886, issued to Fariello et al. which are incorporated for their supported teachings herein.

Figure 2:
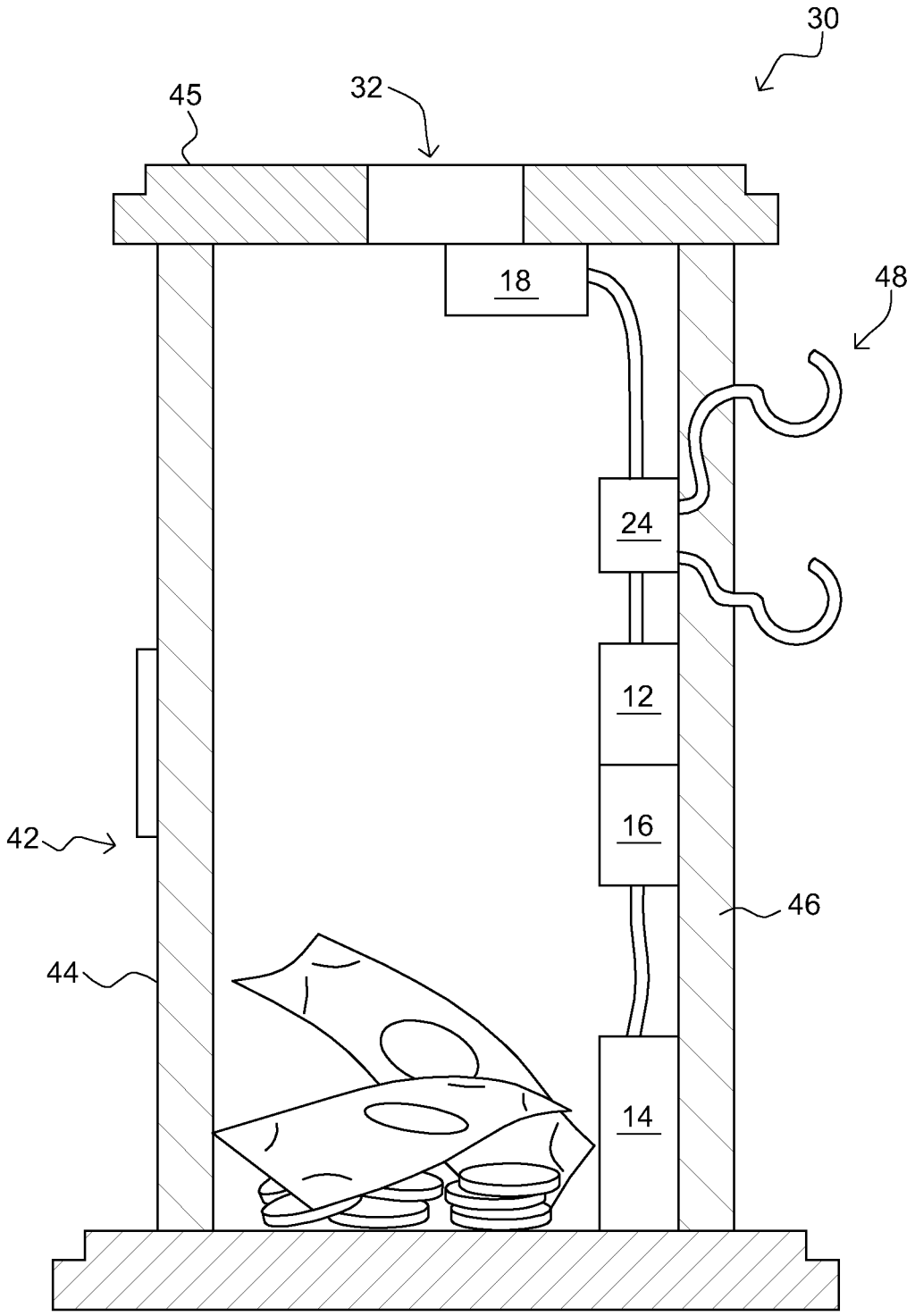
FIG. 2 is a cross-sectional view of a device for saving money, according to one embodiment of the invention.

The illustrated system 10 includes a clock module 28 in communication with the control module 12. The illustrated clock module 28 is configured to display time and may be disposed on an exterior surface of a container of the system. The clock module is in communication with the timing and program module and is configured to provide time interval data thereto. A clock module may include a clock generator such as but not limited to a piezo-electric oscillator, a tank circuit, an RC circuit, and the like. A non-limiting example of a clock module may be an analog clock module as described in U.S. Pat. No. 6,188,253, issued to Gage et al., which is incorporated for its supported teachings herein FIG. 2 is a cross-sectional view of a device for saving money, according to one embodiment of the invention. The device includes a housing configured to store money therein and further includes a control module, a power module, an audio module, a slot sensor module, and a hook sensor module. Accordingly, a user may store money within the device and the device may interact with the user in a manner that promotes positive saving behavior.

The illustrated device is configured to facilitate the learning of saving money. The device 30 includes a container 46 configured to provide a housing for the components and modules of the device. The device 30 includes a slot 32 disposed on a top surface 45 of the container 46 and configured to receive money. The device 30 also includes a hinged door 44 coupled to a side of the container 46 configured to selectively pivot. The illustrated device 30 includes a pair of hook members 48 extending from a side of the container 46. The device 30 includes a locking device 42 coupled to the hinged door 44 and configured to secure the contents of the container 46.

The illustrated device 30 includes a slot sensor module 18 disposed within the container 46 and near the slot 32. The illustrated slot sensor module 18 is configured to sense objects, such as money, passing through the slot 32. The slot sensor module 18 is configured to send a sensor event or a trigger to the audio module 16, through the control module 12 to broadcast an audio message, once an object passes through the slot and is sensed by the slot sensor module.

The illustrated device 30 includes a hook sensor module 24 disposed within the container 46 and near a hook member 48. The hook sensor module 24 is configured to sense utilization of the hook member 48. The hook sensor module is in communication with the control module, the hook member, and the audio module. The hook sensor module is configured to send a sensor event or a trigger to the audio module, through the control module, once an object is placed upon the hook member and is sensed by the hook sensor module.

The illustrated device 30 includes an audio module 16 disposed within the container 46 and in communication with the slot sensor module 18 and the hook sensor module 24. The illustrated audio module 16 is configured to provide audio broadcasts upon receiving a trigger from either the slot sensor module 18 or the hook sensor module 24. The illustrated device 30 includes a power module 14 in communication with the control module 12 and configured to provide power to the components and modules of the device 30. The illustrated power module 14 may be a replacement power source, such as but not limited to batteries, or the power module 14 may include a base power source, such as an outlet power plug configured to directly couple the system 10 to a power source. Non-limiting examples of a power module may be a power module described in U.S. Pat. No. 6,337,803, issued to Kikcuhi et al.; or a power module described in U.S. Pat. No. 5,608,595, issued to Gourab et al. which are incorporated for their supported teachings herein.

The device 30 includes a control module 12 disposed within the container 46 and in communication with the audio module 16, the slot sensor module 18, and the hook sensor module 24. The control module 12 is configured to provide operational controls to the modules of the device 30. The illustrated control module 12 includes a timing module and program module, the program module includes an instruction set providing for an audio broadcast 36 of the audio module 16 triggered by a predetermined association of a sensor event and the passing of a predetermined period of time. The instruction set triggers an audio broadcast 36 when the hook member 48 is utilized and a predetermined period of time passes without the slot sensor module 18 detecting use of the slot 32. The instruction set triggers an audio broadcast 36 when the slot sensor module 18 detects utilization of the slot 32.

In operation of one embodiment of the invention, a user, upon returning home from work or school, enters the home and places his/her keys on a hook member of the device. The device broadcasts an audio message telling the user to deposit money into the slot of the device. The user deposits money into the slot of the device and the device broadcasts another audio message telling the user a congratulatory message about saving money.

In operation of one embodiment of the invention, a user has not deposited money into the money saving device for a couple days. The device is configured to broadcast an audio message telling the user that he/she has not deposited money into the device for a couple days and depositing money is advised. The device is configured to broadcast the audio message everyday at a pre-set time, such as but not limited to after work or after school hours such as 5:30 pm or 6:00 pm, until money is deposited into the slot of the device.

Figure 3:
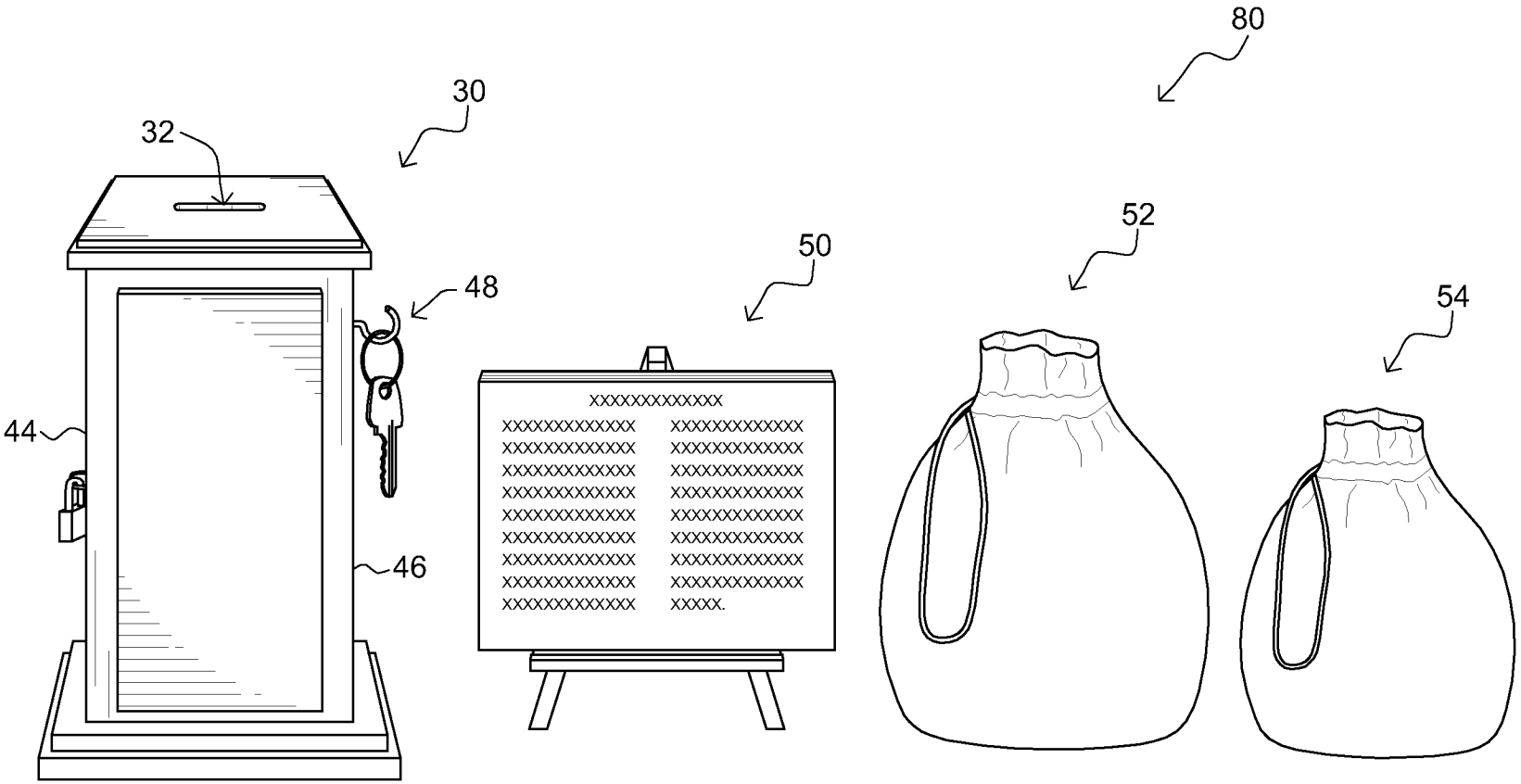
FIG. 3 is a perspective view of a money saving kit, according to one embodiment of the invention.

FIG. 3 is a perspective view of a money saving kit, according to one embodiment of the invention. There is shown a container 30, a first bag 52, a second bag 54, and an instruction booklet 50. The instruction book may be a card, pamphlet, banner, etc. Accordingly, the kit may facilitate the saving of money in a manner that permits a user to store money in one location and transfer the same to another location, such as but not limited to a bank. Further, information associated with the process and reminders of the same may be continually displayed in a manner that maximizes the internalization of the process. In such a manner, positive saving behavior and habits may be developed and promoted.

The illustrated kit 80 includes a device 30 configured to facilitate the saving of money. The illustrated device 30 includes a container 46 configured to provide a housing for the components and modules of the device 30. The kit 80 includes a slot 32 through the container 46 and configured to receive money. The kit 80 also includes a hinged door 44 coupled to a side of the container 46 and configured to selectively pivot open and closed. The kit 80 includes a hook member 48 extending from a side of the container 46. The kit 80 includes a first bag 52 configured to store money and having an internal volume larger than about an internal volume of the container 46. Accordingly, the first bag may be used to transport up to the entire contents of the device to another location. The kit 80 also includes a second bag 54 configured to store money, wherein the second bag is configured to be a personal change bag. The personal change bag may have an internal volume less than that of the device and may facilitate the daily, weekly, etc. saving of money on the person of a user, and the user will have predestined such saving for deposit in the device at a time he/she so chooses. The first bag and the second bag may include a personalized logo displayed thereon.

The illustrated kit 80 includes an instruction booklet 50 (or card) configured to provide instructions for the saving of money. The instruction booklet may include instructions, teachings, and the like configured to promote the proper and continual usage of the device/system. The instruction booklet may be in color, laminated, rigid, and otherwise configured to be prominently displayed in associated with the device. The booklet may include a display mechanism configured to hold the booklet in a visible position.

Figure 4:
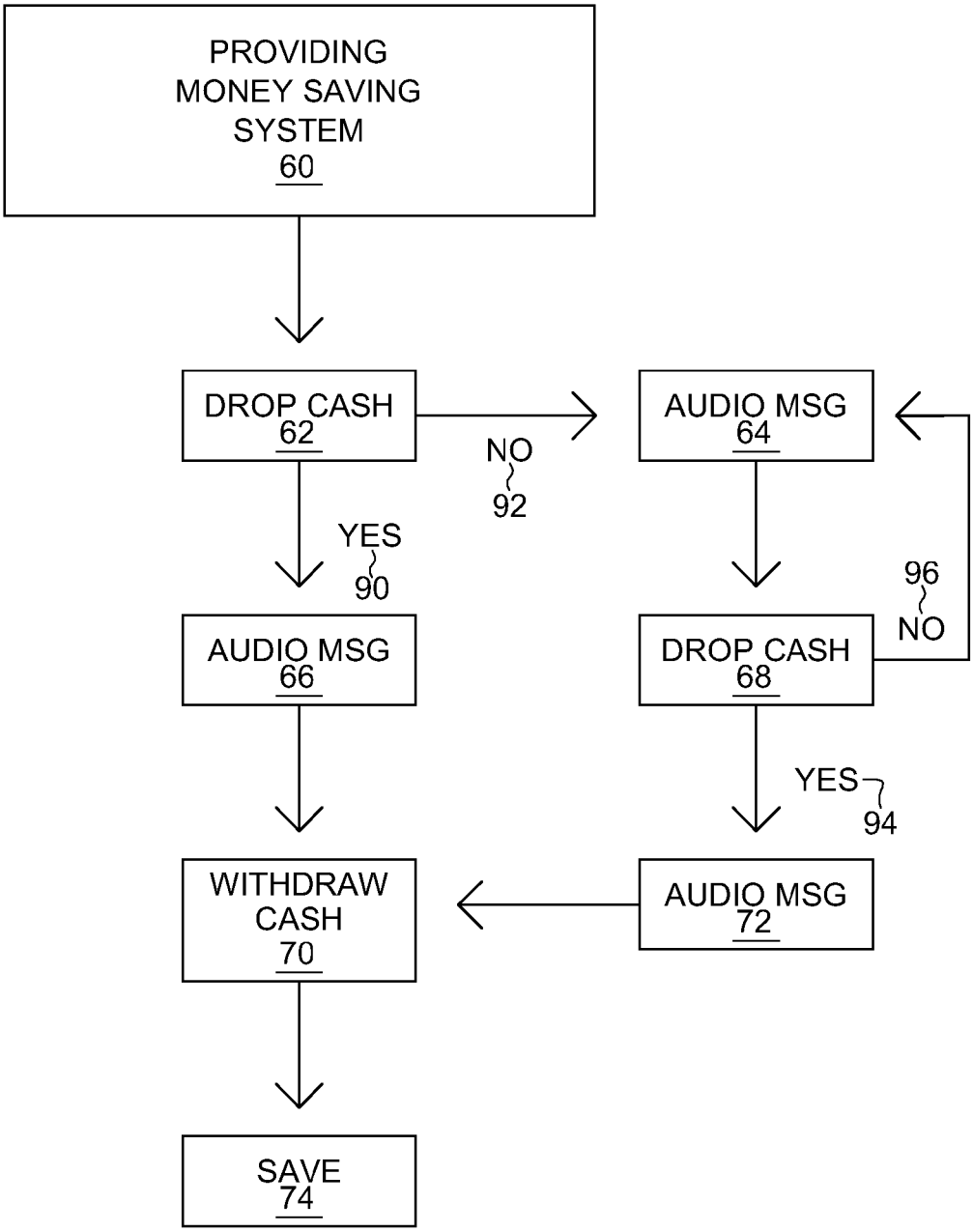
FIG. 4 is a flow chart of a method of saving money using a saving system, according to one embodiment of the invention.

FIG. 4 is a flow chart of a money saving method, according to one embodiment of the invention. The sequence includes providing a money saving system 60 to a user or a family. The user or family drops cash 62 into a container of the money saving system. If the user drops cash into the container 90, or otherwise performs an act consistent with the saving of money, the container is configured to broadcast an audio message 66. The audio message 66 is configured to celebrate or reinforce the thought of saving money to the user. If the user does not drop cash into the container 92, or otherwise perform an act associated with the saving of money, but does perform an act associated with the opportunity to save money (such as but not limited to hanging keys on a key hook at the end of a days labors, the container is configured to broadcast an audio message 64. The audio message 64 is configured to encourage the user to save money and asks the user to deposit money into the container of the system. If after audio message 64, the user drops cash 68 into the container 94, the container is configured to broadcast an audio message 72. The audio message 72 is similar to the audio message 66 configured to celebrate or reinforce the thought of saving money. If after the audio message 64, the user does not drop cash into the container 96, the container is configured to broadcast audio message 64, until the user deposits cash into the container. After audio messages 66, 72 the user may withdraw the cash 70 from the container and take the cash to a banking institution to save 74.

Figure 5:
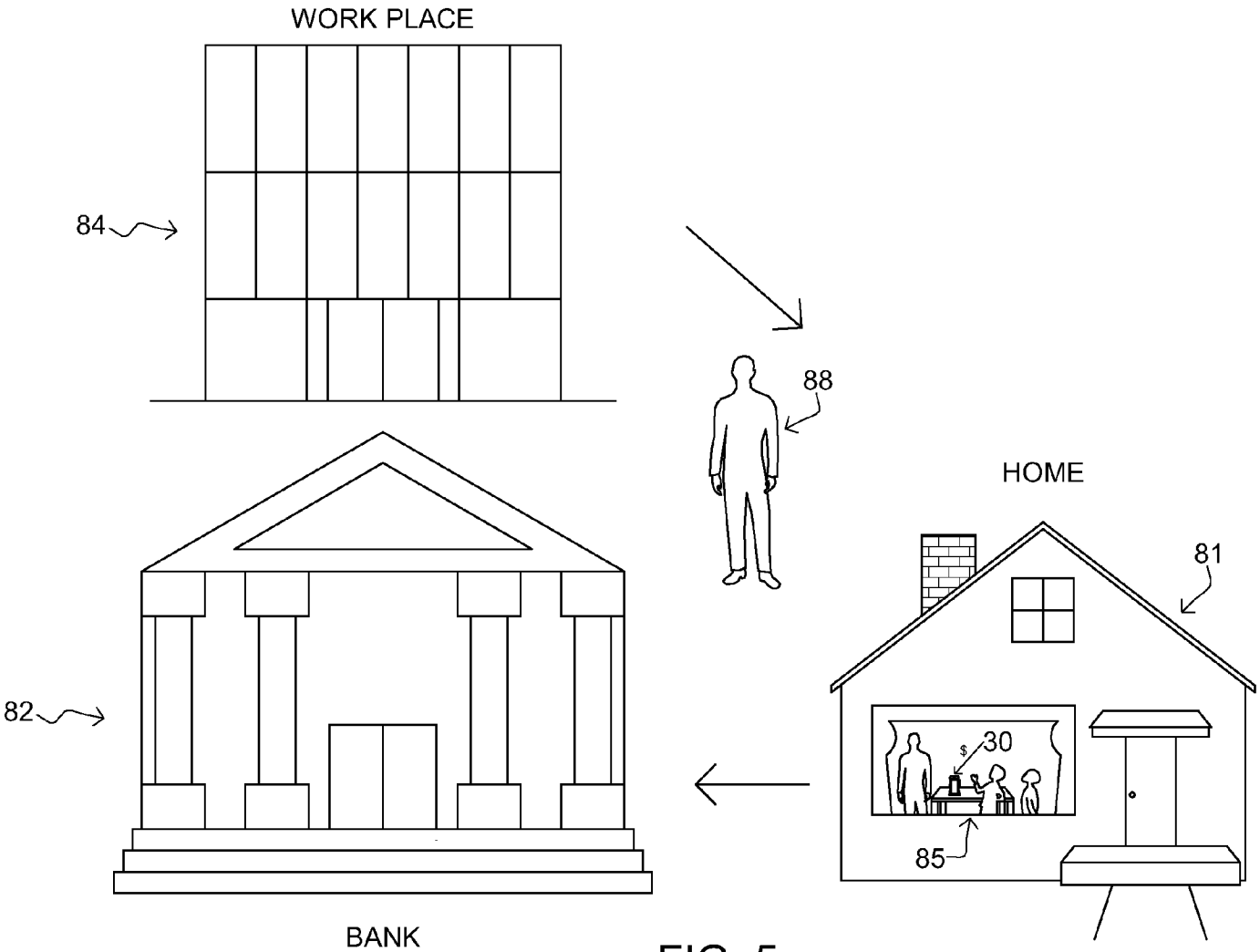
FIG. 5 is a relational diagram of operation of a money saving method, according to one embodiment of the invention.

FIG. 5 is a relational diagram of operation of a money saving method, according to one embodiment of the invention. There is shown a user 88 traveling in between a workplace 84, a home 81, and a banking institution 82.

The illustrated diagram includes a user 88 going to a workplace 84 to make money to support a family 85. The user 88 goes from the workplace 84 to a home 81. In the home 81, the user 88 teaches the family 85 the idea of saving money and how that it is possible through the use of the money saving device/system 30. The device/system facilitates such teachings through interaction with the user and/or family. The family deposits money into the money saving device 30; and once the money saving device 30 is full of money, the user and the family take the money to a banking institution to be saved. Accordingly, families may be enriched financially, intellectually and habit wise.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the audio module is configured to broadcast pre-recorded messages, one skilled in the art would appreciate that the audio module may be configured to record and broadcast personal messages of the user to further motivate the user to use the money saving system. The audio module may include a recording module configured to record audio; and the audio module may include a storage module configured to store recorded messages, and still perform its intended function.

Additionally, although the figures illustrate a rectangular container configured to house the components and modules of the money saving system. One skilled in the art would appreciate that the container may vary in size, shape, design, configuration, color, length, height, width, etc. and still perform its intended function.

It is envisioned that, one skilled in the art would appreciate that the audio module further includes an audio recording module configured to provide recording capabilities to the system. The user would be able to record a personal audio recording to broadcast after a sensor event or trigger, and still perform its intended function.

It is expected that there could be numerous variations of the design of this invention. An example is that the sensors and housing may be different according to the events and acts observed/detected or desired to be observed and/or detected. For example, money takes many forms including but not limited to coins, tokens, paper, electronic data, and the like and the saving of the same may be detected by many different tools, devices, sensors, systems and the like. More, acts associated with the opportunity to save money include but are not limited to routine acts performed at the end of a work-day/week/month/etc., routine or required acts associated with receiving money, and the like.

Finally, it is envisioned that the components of the device may be constructed of a variety of materials, such as but not limited to metal, metal alloys, wood, wood composite, plastics, plastic composite, rubber, rubber composite, glass, textiles, graphite, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A system for facilitating the saving of money, comprising:

a) a container configured to provide a housing for the components and modules of the system;

b) a slot disposed through a top surface of the container and configured to receive money;

c) a hinged door coupled to a side of the container and configured to selectively pivot;

d) a hook member extending outwardly from a side of the container;

e) a slot sensor module disposed within the container and near the slot, configured to sense objects passing through the slot;

f) a hook sensor module in communication with the hook member and configured to sense utilization of the hook member;

g) an audio module coupled to the container and configured to provide audio broadcasts;

h) a control module disposed within the container and in communication with the audio module, the slot sensor module, and the hook sensor module, and configured to provide operational controls to the modules of the system;

i) a first bag, configured to store money and having an internal volume larger than about an internal volume of the container;

j) a second bag, configured to store money; wherein the control module further includes a timing module and program module, the program module including an instruction set providing for an audio broadcast of the audio module triggered by a predetermined association of a sensor event and the passing of a predetermined period of time; wherein the instruction set triggers an audio broadcast when the hook member is utilized and a predetermined period of time passes without the slot sensor module detecting use of the slot.

2. The system of claim 1, wherein the instruction set triggers an audio broadcast when the slot sensor module detects utilization of the slot.

3. The system of claim 1 further comprising a locking device coupled to the hinged door and configured to secure the contents of the container.

4. The system of claim 1 further comprising a power module in communication with the control module and configured to provide power to the components and modules of the system.

5. The system of claim 1 further comprising a wall mount coupled to an exterior surface of the container and configured to couple the container to a wall or surface.

6. The system of claim 1 further comprising a clock module in communication with the control module and configured to display a time.

7. A kit for facilitating the saving of money, comprising:

a) a container configured to provide a housing for the components and modules of the kit;

b) a slot through the container and configured to receive money;

c) a hinged door coupled to a side of the container and configured to selectively pivot;

d) a hook member extending from a side of the container;

e) a first bag, configured to store money and having an internal volume larger than about an internal volume of the container;

f) a second bag, configured to store money;

g) an instruction booklet configured to provide instructions for the saving of money; h) a slot sensor module disposed within the container near the slot, configured to sense objects passing through the slot; i) a hook sensor module in communication with the hook member and configured to sense utilization of the hook member; j) an audio module coupled to the container configured to provide audio broadcasts; and k) a control module disposed within the container and in communication with the audio module, the slot sensor module, and the hook sensor module, and configured to provide operational controls to the modules of the kit.

8. The kit of claim 7, wherein the control module further includes a timing module and program module, the program module including an instruction set providing for an audio broadcast of the audio module triggered by a predetermined association of a sensor event and the passing of a predetermined period of time.

9. The kit of claim 7, further comprising a locking device coupled to the hinged door and configured to secure the contents of the container.

10. The kit of claim 7, wherein the second bag is a personal change bag.

11. A device for facilitating the saving of money, comprising:

a) a container configured to provide a housing for the components and modules of the device;

b) a slot disposed on a top surface of the container and configured to receive money;

c) a hinged door coupled to a side of the container and configured to selectively pivot;

d) a hook member extending from a side of the container e) a slot sensor module disposed within the container near the slot, configured to sense objects passing through the slot;

f) a hook sensor module disposed within the container near the hook member, configured to sense utilization of the hook member;

g) an audio module disposed within the container and in communication with the slot aperture sensor module and the hook sensor module, and configured to provide audio broadcasts; and h) a control module disposed within the container and in communication with the audio module, the slot sensor module, and the hook sensor module and configured to provide operational controls to the modules of the device; and wherein the control module further includes a timing module and program module, the program module including an instruction set providing for an audio broadcast of the audio module triggered by a predetermined association of a sensor event and the passing of a predetermined period of time.

12. The device of claim 11, wherein the instruction set triggers an audio broadcast when the hook member is utilized and a predetermined period of time passes without the slot sensor module detecting use of the slot.

13. The device of claim 12, wherein the instruction set triggers an audio broadcast when the slot sensor module detects utilization of the slot.

14. The device of claim 13, further comprising a locking device coupled to the hinged door and configured to secure the contents of the container.

15. The device of claim 14, further comprising a power module in communication with the control module and configured to provide power to the components and modules of the device.

* * * * *